US005688429A

United States Patent [19]

Zakikhani et al.

[11] Patent Number: 5,688,429

[45] Date of Patent: Nov. 18, 1997

[54] FLAME-RETARDANT AND FABRIC-SOFTENING TREATMENT OF TEXTILE MATERIALS

[75] Inventors: Mohsen Zakikhani; Xiao Ping Lei, both of Birmingham, England

[73] Assignee: Albright & Wilson UK Limited, West Midlands, England

[21] Appl. No.: 545,364

[22] Filed: Oct. 17, 1995

[30] Foreign Application Priority Data

Oct. 25, 1994 [GB] United Kingdom ..... 9421424

[51] Int. Cl.[6] ..... D06M 13/313; D06M 13/322

[52] U.S. Cl. ..... 252/8.61; 8/115.6; 8/115.64; 8/115.7; 8/195; 8/196; 106/18.15; 106/18.18; 106/18.19; 106/18.12; 252/8.63; 252/608; 510/515

[58] Field of Search ..... 252/8.6, 8.8, 8.61, 252/8.63, 608; 8/115.7, 127.1, 128.1, 115.6, 115.64, 194, 195, 196; 106/18.12, 18.15, 18.18, 18.19; 510/515

[56] References Cited

U.S. PATENT DOCUMENTS

| | | | |
|---|---|---|---|
| 4,311,855 | 1/1982 | Cole et al. | 106/18.17 |
| 4,765,796 | 8/1988 | Harper, Jr. et al. | 8/115.7 |
| 4,842,609 | 6/1989 | Johnson | 8/115.7 |
| 4,902,300 | 2/1990 | Johnson et al. | 8/115.7 |
| 4,909,805 | 3/1990 | Smith | 8/127.1 |
| 5,139,531 | 8/1992 | Cole et al. | 8/127.1 |
| 5,238,464 | 8/1993 | Johnson et al. | 8/127.1 |
| 5,378,243 | 1/1995 | Lei et al. | 8/196 |
| 5,480,458 | 1/1996 | Fleming et al. | 8/115.58 |

FOREIGN PATENT DOCUMENTS

A-2 290 562 1/1996 United Kingdom .

*Primary Examiner*—Anthony Green

*Attorney, Agent, or Firm*—Frishauf, Holtz, Goodman, Langer & Chick, P.C.

[57] ABSTRACT

A one-pack composition conferring flame-retardant and fabric-softening properties on fabrics comprises a $THP^+$ salt, an organic nitrogen compound (eg urea) and a hydroxyl-reactive organic compound having 12 or more carbon atoms. Preferred examples of such compounds include $C_{12}$ amine, $C_{18}$ amine and tallow amine (viz $C_{16}/C_{18}/C_{20}$ amine mixture).

29 Claims, No Drawings

FLAME-RETARDANT AND FABRIC-SOFTENING TREATMENT OF TEXTILE MATERIALS

This invention relates to a composition adapted to confer flame-retardant and fabric-softening properties on a textile material, to a method for making said composition and to a fabric treated with said composition.

A known process for the flame-retardant treatment of fabrics including cellulosic (e.g. cotton) fibres consists of impregnation of the fabric with an aqueous solution of a poly(hydroxyorgano) phosphonium compound, for example a tetrakis (hydroxyorgano) phosphonium ($THP^+$) salt. Alternatively, the poly(hydroxyorgano) phosphonium compound may comprise a condensate with a nitrogen—containing compound such as urea. Following impregnation, the fabric is dried and then cured with ammonia to produce a cured, water-insoluble polymer which is mechanically fixed within the fibres of the fabric. After curing, the polymer is oxidised to convert trivalent phosphorus to pentavalent phosphorus and the fabric is washed and dried. Fabrics treated according to the aforesaid process and garments made from such treated fabrics are sold under the Registered Trade Mark PROBAN of Albright & Wilson Limited.

Our United Kingdom Specification No. GB-A-2271787 discloses the addition of one or more protonated and neutralized amines (for example amine acetates) to the impregnation solution. This addition has been found to increase the efficiency of fixation of the phosphonium compound within the fibres, and to improve uniform distribution of the phosphonium compound in the system, which in turn has been found to lead to improved flame-retardant and increased water-repellent properties.

Our United Kingdom Specification No. GB-A-2040299 discloses the addition of an inorganic base or a $C_1$–$C_4$ tertiary amine base to the $THP^+$ compound, before condensation with urea. However, the aforementioned GB-A-2040299 does not address the question of the softness (drape) of the textile material when treated with the product of this disclosure.

Our co-pending Application No. GB 94 12484.9 discloses a method for increasing the add-on of the $THP^+$ compound to a fibre, resulting in enhancement of flame-retardant properties.

We have now found that the addition, to an aqueous mixture era $THP^+$ salt and an organic nitrogen compound, of a primary or secondary aliphatic amine having 12 or more carbon atoms, before reacting the ingredients to bring about condensation of the $THP^+$ salt and the organic nitrogen compound, leads to the production era composition which, when used to treat textile materials according to the aforesaid PROBAN process, confers on the textile materials not only flame-retardant properties but also enhanced fabric-softening properties.

Accordingly, the present invention provides a composition adapted to coffer flame-retardant and fabric-softening properties on a textile material, in which said composition comprises the product obtained by the reaction of (a) a tetrakis (hydroxyorgano) phosphonium (THP+) salt;

(b) an amide selected from the group consisting of urea and thiourea; and (c) an aliphatic, hydroxyl-reactive compound containing at least one alkyl group having from 12 to 30 carbon atoms.

The present invention also provides a textile material treated with the composition described in the immediately-preceding paragraph.

The present invention further provides a method for making the aforesaid composition, in which the method comprises the following stages:

(i) placing the $THP^+$ salt (a) in a vessel and adjusting its pH to about 6.0 by the addition of an inorganic base;

(ii) dissolving in the $THP^+$ salt/base solution the amide (b);

(iii) adding the compound (c) to the mixture [(a)+(b)];

(iv) maintaining the mixture [(a)+(b)+(c)] at an appropriate temperature for a time sufficient to bring about the formation of a condensation product between (a) and (b);

(v) cooling the product; and (vi) adding sufficient water to the product to make a stable solution of said product.

The present invention yet further provides a composition made by the method described in the immediately—preceding paragraph.

The $THP^+$ salt (a) is preferably a tetrakis (hydroxyalkyl) phosphonium salt, for example tetrakis (hydroxymethyl) phosphonium chloride (THPC) or tetrakis (hydroxymethyl) phosphonium sulphate (THPS).

The compound (c) may be, for example, any one or more of the following (each containing at least one alkyl group having from 12 to 30 carbon atoms and preferably from 12 to 20 carbon atoms):

(i) Primary amines
(ii) Secondary amines
(iii) Tertiary amines
(iv) Diamines
(v) Quaternary ammonium salts
(vi) Ethoxylated amines
(vii) Ethoxylated diamines
(viii) Amine oxides
(ix) Alkyl amino-substituted carboxylic acids
(x) Amides
(xi) Ethoxylated amides
(xii) Amido—imidazolines
(xiii) Siloxane derivatives
(xiv) Silane derivatives Where compound (c) is an amine it may, for example, consist essentially of n dodecylamine ($C_{12}H_{25}NH_2$) or of n-octadecylamine ($C_{18}H_{37}NH_2$).

Alternatively, compound (c) may be tallow amine, which is believed to comprise n-hexadecylamine ($C_6H_{33}NH_2$), n-octadecylamine ($C_{18}H_{37}HN_2$) and n-eicosylamine ($C_{20}$; $H_{42}NH_2$).

Preferably, the molar ratio of the $THP^+$ salt (a) to the sum of the molar ratios of the organic nitrogen compound (b) and compound (c), i.e. a:(b+c), is in the range 4:1 to 1.5:1, suitably from 2.5:1 to3:1.

For example, the molar ratio a:b:c may be any of the following:

| | |
|---|---|
| | 4:0.95:0.05 |
| | 3.5:0.95:0.05 |
| | 3:0.95:0.05 |
| | 2.5:0.95:0.05 |
| | 2.5:0.9:0.1 |
| | 2.5:0.75:0.25 |
| | 2.0:0.95:0.05 |
| | 2:0.9:0.1 |
| or | 1.5:0.95:0.05 |

The textile material may comprise substantially 100% cellulosic fibres (e.g. cotton, linen, jute. hessian or regenerated cellulosic material).

Alternatively, the textile material may comprise both cellulosic fibres, and non-cellulosic fibres. The non-cellulosic fibres may be, for example, wool or silk fibres or they may comprise synthetic fibres such as polyester, polyamide, acrylic or aramid fibres.

The textile material is suitably one including cellulosic (e.g. cotton) fibres or may comprise cotton fibres and polyester fibres, for example 60% cotton fibres and 40% polyester fibres.

In the method of the present invention, the inorganic base used in stage(i) may be, for example, sodium hydroxide or potassium hydroxide.

In stage (iv) of the method, the mixture may, for example, be maintained at reflux temperature for 3 to 4 hours. This stage may be carried out at atmospheric pressure or at a pressure higher than atmospheric, e.g. around 1.25 bar.

In stage (vi) of the method, sufficient water may be added to the product to make a 60% stable solution.

Although it is not intended that the present invention be construed with respect to any particular theory, it is believed that the adjustment of the pH of the THP+ salt to about 6.0 may render the salt more reactive towards the organic nitrogen compound. It is also believed that the demonstrably softer handle (drape) of the treated textile material may in part result from a reduced degree of cross-linking of the $THP^+$ salt/compound (c) condensate on to the material and/or from the presence of compound (c) in the chain. It is further believed that the treatment of Textile materials according to the present invention may lead to an improvement in tear-strength and in resistance to abrasion.

The present invention will be illustrated by way of the following Examples:

EXAMPLE 1

To a two-liter resin pot fitted with a condenser was added 1400 grams of tetrakis (hydroxymethyl) phosphonium chloride (THPC). The pH was adjusted to about 6 by adding 75 grams of a 50% potassium hydroxide solution. 132 grams of urea was introduced to the resin pot, and was allowed to dissolve while stirring.

38 grams of n-octadecylamine (available as ARMEEN* HTD) was introduced to the pot, and the temperature was raised to reflux. The mixture was kept at the reflux temperature for 3–4 hours until all the amine had disappeared. Heating was stopped, and water was added to make a 60% solution.

The molar ratio of THPC: urea: n-octadecylamine was 2.5:0.95:0.05.

A 100% cotton fabric of weight 280 g/m2 was padded with the above liquor to a 40% PROBAN* add-on, and processed according to the known PROBAN* process. The finished fabric had a dry add-on of 18.5% condensation product.

The fabric processed with the above liquor was found to contain 2.75% P and 2.38% N, and passed the German (a), French (b), and British (c) FR tests, both before and after a 40 wash cycle at 93° C.

Notes to Example 1:-

* The words ARMEEN and PROBAN are Registered Trade Marks.

(a) DIN 66083 s-b (b) NFG 07-184

(c) BS 6249

EXAMPLES 2 to 6

The process of Example I was repeated and tho quantities and results are shown in TABLE 1 (below):

TABLE I

| Ex. No. | (a) THPC (g) | 50% KOH (g) | (b) Urea (g) | (c) Amine (g) | Molar ratio (a:b:c) | Dry add-on (%) | Processed fabric content of: P (%) | N (%) |
|---|---|---|---|---|---|---|---|---|
| 2 | 1190 | 60 | 108 | 48* | 2.5:0.75:0.25 | 17.6 | 2.6 | 2.25 |
| 3 | 1428 | 75 | 171 | 36* | 2:0.95:0.25 | 19 | 2.77 | 2.55 |
| 4 | 1190 | 60 | 108 | 48* | 2.5:0.9:0.1 | 17.6 | 2.6 | 2.25 |
| 5 | 1428 | 75 | 162 | 72* | 2:0.9:0.1 | 19 | 2.6 | 2.44 |
| 6 | 1190 | 101 | 108 | 18.5+ | 2.5:0.9:0.1 | — | 2.96 | 2.52 |

*n - octadecylamine
+n - dodecylamine

All the fabrics in Examples 2 to 6 (above) passed the flame-retardancy tests listed in Example 1.

EXAMPLES 7 to 10

The process of Example 1 was again repeated, but these Examples only related to the preparation of the flame-retardant composition and not to its use on textile materials. The quantities are shown in TABLE 2 (below);

TABLE 2

| Ex. No. | (a) THPC (g) | 50% KOH (g) | (b) Urea (g) | (c) Amine (g) | Molar Ratio (a:b:c) | Notes |
|---|---|---|---|---|---|---|
| 7 | 1190 | 66 | 95 | 20 | 3:0.95.0.05 | |
| 8 | 1190 | 60 | 71 | 15 | 4:0.95:0.05 | |
| 9 | 1190 | 60 | 81.4 | 17 | 3.5:0.95:0.05 | |
| 10 | 1074 | 60 | 171 | 36 | 1.5:0.95:0.05 | Formed a polymeric gel |

The fabrics treated with the products of Examples 1 to 6 (above) showed greatly improved fabric handle and drape when compared to fabrics treated with a formulation according to the aforesaid GB-A-2040299.

EXAMPLES 11 to 15

Example 1 was repeated using a molar ratio of THPC: Urea: Amine of 3:0.95:0.05 under the pressures, temperatures, and times shown TABLE 3 (below):

TABLE 3

| Example | Temperature oc | Pressure Bar | Time min |
|---|---|---|---|
| 11 | 105–108 | Atmospheric | 180 |
| 12 | 110 | 0.5 | 150 |
| 13 | 130 | 1.25 | 20 |
| 14 | 130 | 1.25 | 20 |
| 15 | 130 | 1.25 | 20 |

A 100% cotton fabric of weight 280 g/m$^2$ was processed using the aforesaid product. The processed fabric was found to have a phosphorus and nitrogen content of 3 and 2.5% respectively, and passed the German, French, British, and the new European Pr EN 533 flame-retardancy tests after 40 washes at 93°.

EXAMPLES 16 to 20

Example 11 was repeated using the fabrics shown in TABLE 4 (below):

TABLE 4

| | Fabric Composition % | | | Fabric Weight |
|---|---|---|---|---|
| Example | Cotton | PET* | Construction | g/m$^2$ |
| 16 | 100 | 0 | Twill | 280 |
| 17 | 100 | 0 | Plain | 155 |
| 18 | 100 (pigment printed) | 0 | Plain | 185 |
| 19 | 75 | 25 | Twill | 255 |
| 20 | 65 | 35 | Twill | 280 |

*PET = polyethylene terephthalate.

The treated fabrics passed the German, French, British, and the new European Pr EN 533 flame-retardancy standards after the required durability washes.

Table 5 (below) shows the P&N results before and after the durability wash.

TABLE 5

| Ex- | P & N % Content (as finished) | | P & N % Content (after wash) | |
|---|---|---|---|---|
| ample | P % | N % | P % | N % |
| 16 | 3.05 | 2.46 | 2.84 | 2.26 |
| 17 | 4.55 | 3.65 | — | —* |
| 18 | 2.98 | 2.45 | 2.10 | 1.63 |
| 19 | 3.02 | 2.46 | 3.01 | 2.24 |
| 20 | 3.49 | 2.81 | 2.97 | 2.42 |

*Example 17 was subjected to an extended 200 cycle durability wash at 74° C. with an oxidising agent free detergent. The fabric content 2.80% phosphorus and 2.21% nitrogen after the durability and passed th BS 5867 part 2 Type B test.

Furthermore, the fabrics showed an excellent handle and drape. In addition, the treated fabrics were water repellent.

Throughout this description and claims, the term "hydroxyl-reactive" is used in the sense of a compound having at least one available hydrogen atom capable of combination with at least one available hydroxyl group on another compound, such combination leading to the elimination of water by way of a "condensation" reaction.

We claim:

1. A composition for both flame-retarding and fabric-softening a textile material, wherein said composition comprises a product obtained by the reaction of:

(a) a tetrakis (hydroxyorgano)phosphonium ($THP^+$) salt;

(b) an amide selected from the group consisting of urea and thiourea; and (c) an aliphatic hydroxyl-reactive compound containing at least one alkyl group having from 12 to 30 carbon atoms.

2. The composition of claim 1, wherein said $THP^+$ salt (a) is a tetrakis (hydroxyalkyl) phosphonium salt selected from the group consisting of tetrakis (hydroxymethyl) phosphonium chloride (THPC) and tetrakis (hydroxymethyl) phosphonium sulphate (THPS).

3. The composition of claim 1, wherein said compound (c) contains at least one alkyl group having from 12 to 20 carbon atoms.

4. The composition of claim 3, wherein said compound (c) is selected from the group consisting of primary amines and secondary amines.

5. The composition of claim 1, wherein said compound (c) is selected from the group consisting of diamines, quaternary ammonium salts, ethoxylated amines, ethoxylated diamines, amine oxides, alkylamino-substituted carboxylic acids, amides, ethoxylated amides, amido-imidazolines, siloxanes and silane derivatives.

6. The composition of claim 4, wherein said compound (c) consists essentially of n-dodecylamine ($C_{12}H_{25}NH_2$).

7. The composition of claim 4, wherein said compound (c) consists essentially of n-octadecylamine ($C_{18}H_{37}NH_2$).

8. The composition of claim 4, wherein said compound (c) comprises n-hexadecylamine ($C_{16}H_{33}NH_2$), n-octadecylamine ($C_{18}H_{37}NH_2$) and n-eicosylamine ($C_{20}H_{41}NH_2$).

9. The composition of claim 1, wherein the molar ratio of said $THP^+$ salt (a) to the sum of the molar ratios of said amide (b) and said compound (c) is in the range 4; 1 to 1.5:1.

10. The composition of claim 9, wherein said molar ratio is about 2.5:1.

11. The composition of claim 1, wherein the molar ratio of said $THP^+$ salt (a) to said amide (b) and said compound (c) is in the range (4 to 1.5): (0.95 to 0.75): (0.25 to 0.05).

12. The composition of claim 11, wherein said molar ratio a:b:c is 3.5:0.95:0.05.

13. The composition of claim 11, wherein said molar ratio a:b:c is 3:0.95:0.05.

14. The composition of claim 11, wherein said molar ratio a:b:c is 2.5:0.95:0.05.

15. The composition of claim 11, wherein said molar ratio a:b:c is 2.5:0.9:0.1.

16. The composition of claim 11, wherein said molar ratio a:b:c is 2.5:0.75:0.25.

17. The composition of claim 11, wherein said molar ratio a:b:c is 2.0:0.95:0.05.

18. The composition of claim 11, wherein said molar ratio a:b:c is 2:0.9:0.1.

19. The composition of claim 11, wherein said molar ratio a:b:c is 1.5:0.95:0.05.

20. A textile material having been flame-retarded and having been softened by treatment with the composition of claim 1.

21. The material of claim 20, said material consisting essentially of cellulosic fibres.

22. The material of claim 20, wherein said cellulosic fibres are selected from the group consisting of cotton, linen, jute, hessian and regenerated cellulosic materials.

23. The material of claim 20, said material comprising cotton fibres and fibres selected from the group consisting of wool and silk fibres.

24. The material of claim 20, said material comprising cotton fibres and synthetic fibres selected from the group consisting of polyester fibres, polyamide fibres, acrylic fibres and aramid fibres.

25. The material of claim 24, said material comprising 60% cotton fibres and 40% polyester fibres.

26. A method for making a composition for flame retarding and fabric softening a textile material, wherein said method comprises the following stages:

(i) placing a tetrakis (hydroxyalkyl) phosphonium salt (THP+) solution in a vessel and adjusting its pH to about 6.0 with an inorganic base to form a first mixture;

(ii) dissolving an amide selected from the group consisting of urea and thiourea in the first mixture to form a second mixture;

(iii) adding an aliphatic hydroxyl-reactive compound, said aliphatic hydroxyl-reactive compound containing at least one alkyl group having from 12 to 30 carbon atoms, to the second mixture;

(iv) maintaining the second mixture at an appropriate temperature for a time sufficient to bring about the formation of a condensation product between the tetrakis (hydroxyalkyl) phosphonium salt and the amide;

(v) cooling the product; and (vi) adding sufficient water to the product to make a stable solution of said product.

27. The method of claim 26, wherein said inorganic base used in said stage (i) is selected from the group consisting of sodium hydroxide and potassium hydroxide.

28. The method of claim 26 wherein, in said stage (iv), said mixture is maintained at reflux temperature for 3 to 4 hours.

29. The method of claim 26 wherein, in said stage (vi), sufficient water is added to said product (i) to make a 60% stable solution of said product.

* * * * *